US005156549A

United States Patent [19]

Wehrell

[11] Patent Number: 5,156,549

[45] Date of Patent: Oct. 20, 1992

[54] REFLEX TRAINING DEVICE AND METHOD

[76] Inventor: Michael A. Wehrell, 2648 The Strand, Hermosa Beach, Calif. 90254

[21] Appl. No.: 610,952

[22] Filed: Nov. 9, 1990

[51] Int. Cl.[5] ..... A63B 69/00

[52] U.S. Cl. ..... 434/258; 434/259

[58] Field of Search ..... 434/258, 259; 272/93, 272/98, 74, 76, 77, 112, 116, 137, 135, 900; 273/441, 1.5 A, 85 R, 85 A, 85 B, 85 C, 850, 445, 446

[56] References Cited

U.S. PATENT DOCUMENTS

| | | | |
|---|---|---|---|
| 3,933,354 | 1/1976 | Goldfarb et al. | 434/258 X |
| 4,201,399 | 5/1980 | William | 272/76 |
| 4,353,545 | 10/1982 | Anderson | 273/446 X |
| 4,401,303 | 8/1983 | Anderson et al. | 272/76 |
| 4,844,461 | 7/1989 | Namanny et al. | 272/76 |

*Primary Examiner*—Richard J. Apley

*Assistant Examiner*—Glenn E. Richman

*Attorney, Agent, or Firm*—Rogers & Killeen

[57] ABSTRACT

An athletic exercise device and method for improving an athlete's reflexes may include cushioned arms that are moved laterally toward the athlete so that the athlete must move to avoid the arms. In certain body contact sports, such as boxing and karate, athletes with improved reflexes to avoid blows have an advantage. By selectively moving the arms of the present invention toward the athlete and thereby training the athlete to avoid being struck by the arms, the reflexes for such sports may be improved. The arms may extend through slots in a vertical backboard and be moved by a trainer positioned behind the backboard. Elastic cord may be provided to retract the arms away from the athlete and the backboard may be mobile to enhance training effectiveness.

13 Claims, 5 Drawing Sheets

REFLEX TRAINING DEVICE AND METHOD

BACKGROUND OF THE INVENTION

The present invention relates to an exercise device and method for improving the reflexes of participants in sports activities that call for highly developed avoidance reflexes. Athletes with improved reflexes as developed by the present invention often have a competitive edge in such sports as boxing, karate, judo and similar body contact sports. The invention also has utility in reflex training and conditioning for sports such as football, basketball and soccer.

The training to improve reflexes for such sports as boxing frequently requires the participation of another athlete, such as a sparring partner, to provide the blows which the training athlete is to be taught to avoid. Such training can be harmful to the athlete when, for example, the sparring partner's blows are not avoided. The present invention may lessen the potential for harm from reflex training by providing cushioned and/or light-weight arms that may be moved toward a training athlete at a speed and from a direction selected by the athlete's trainer. The arms, being cushioned, provide only a light slap when the athlete fails to avoid them.

Further, the efficiency of reflex training may be reduced by a sparring partner who does not follow directions from the athlete's trainer. This may be important where, for example, a boxer is to be taught not to drop his fists. A poor sparring partner may not take advantage of the dropped fists to deliver a blow that the athlete is to be taught to avoid.

The efficiency of reflex training may be improved by use of the present invention because the blows delivered thereby can be timed and directed by the trainer. The trainer, being positioned behind a backboard through which the arms extend, is free to concentrate on the athlete's responses and move the arms to solicit desired responses. The arms may be positioned around the athlete so that he is forced to avoid blows to various parts of the body, such as the knees (as in a karate kick simulation), the torso (as in a boxing jab simulation) or the head (when improving bobbing and weaving reflexes).

Accordingly, it is an object of the present invention to provide a novel training device for improving the reflexes of an athlete that obviates the problems of the prior art and that does not harm the athlete during training.

It is another object of the present invention to provide a novel reflex training device that has plural arms adapted to be moved with a speed and from a direction selected by the trainer.

It is yet another object of the present invention to provide a novel training method for improving the reflexes of an athlete that does not require the participation of a second athlete, such as a sparring partner.

These and many other objects and advantages will be readily apparent to one skilled in the art to which the invention pertains from a perusal of the claims and the following detailed description of preferred embodiments when read in conjunction with the appended drawings.

THE DRAWINGS

DETAILED DESCRIPTION OF PREFERRED EMBODIMENTS

With reference to the figures where like elements have been given like numerical designations to facilitate an understanding of the present invention, and particularly with reference to a first embodiment of the training device illustrated in FIGS. 1 through 4, the device may include arms 10 carried by a backboard 20 and extending through slots 30 in the background, the slots 30 defining the range of movement of the arms 10.

Figure 1:
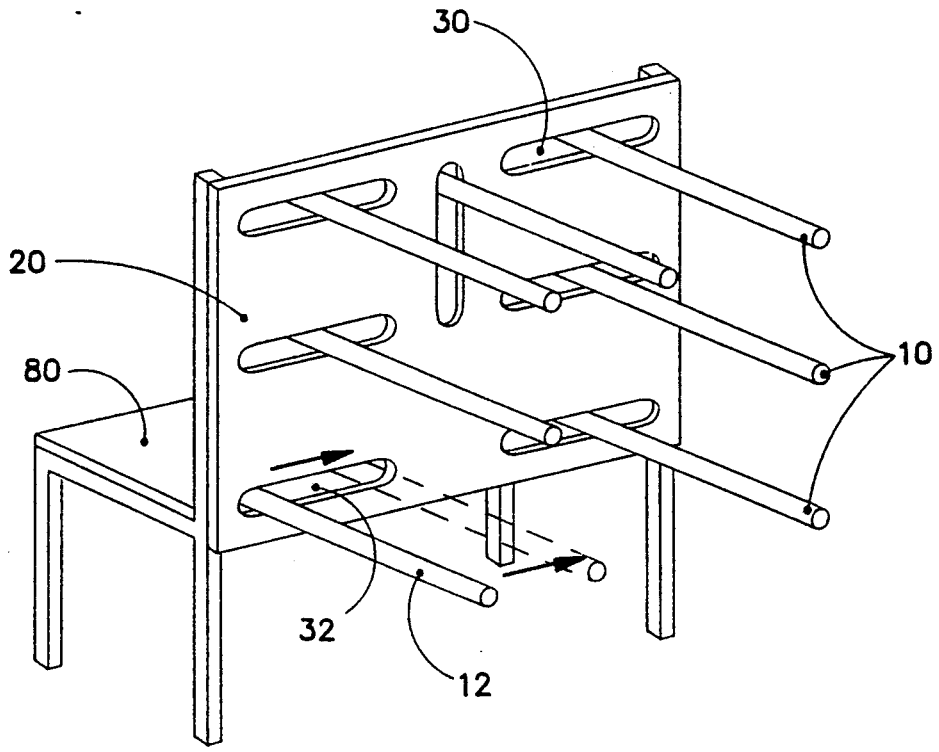
FIG. 1 is a perspective view of a pictorial representation of a first embodiment of the present invention.
Figure 2:
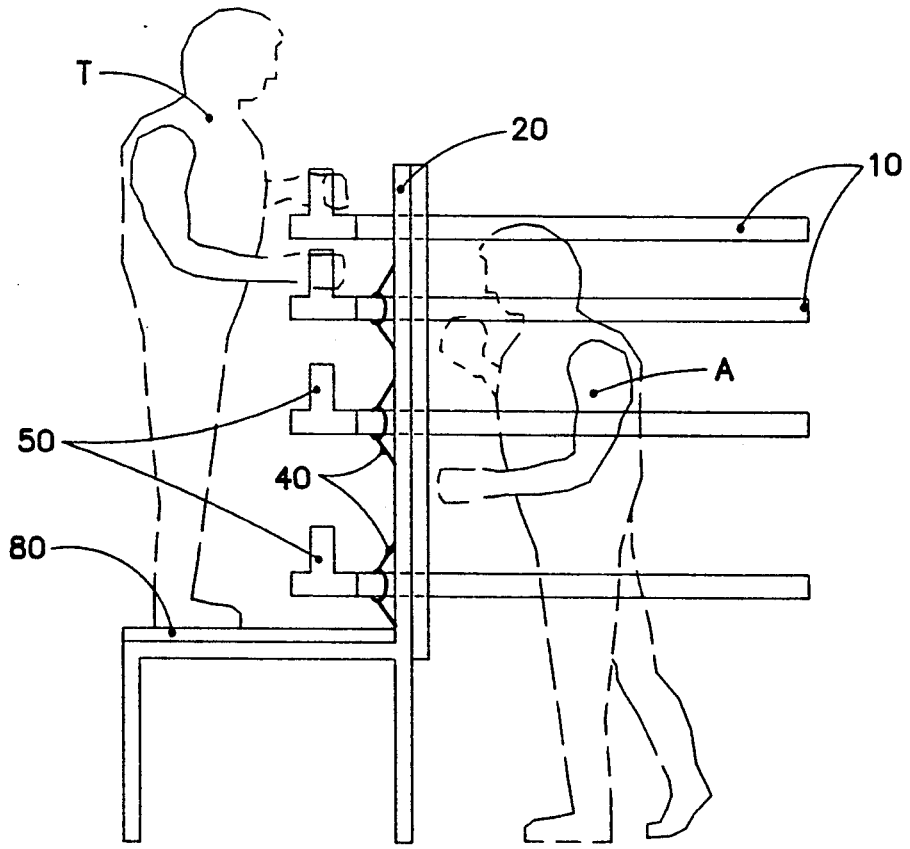
FIG. 2 is a side view of the embodiment of FIG. 1 showing an athlete and a trainer in outline form using the device.
Figure 3:
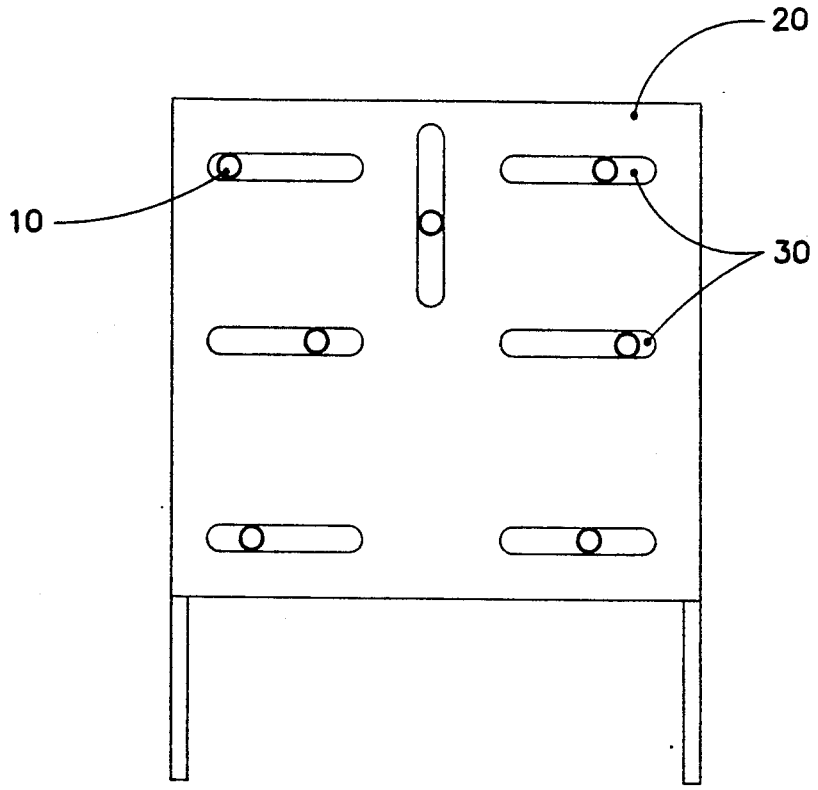
FIG. 3 is a front plan view of the embodiment of FIG. 1.

The operation of the present invention may be seen more clearly with reference to FIG. 2. The athlete A may be positioned facing and near the center of the backboard 20. The arms 10 may extend beyond the back of the athlete and may be located at positions appropriate for the sport to which the training is directed. The athlete may take a position among the arms 10 so that none of the arms touch the athlete until moved by the trainer T. The trainer may be positioned on the opposite side of the backboard so that the trainer can move the arms toward the athlete from the direction and with the speed selected by the trainer. The movement of the arms is illustrated in FIG. 1, in which, for example, arm 12 may move laterally in slot 32, toward and away from the center of the backboard 20.

The arms 10 may be made of any suitable material, although a lightweight material, such as tubular plastic, is preferred. Where appropriate, the arms may be flexible to provide a whipping action when they are moved toward the athlete. The arms may also be rigid with a springed hinge that yields when the arms strike the athlete. The arms may be cushioned with appropriate materials, such as a foam, to prevent harm to the athlete. The arms may extend from the backboard a distance sufficient to reach beyond the back of the athlete when the athlete is facing the backboard. With the arms so extended, potential harm to the athlete, such as by a poke in the eye, may be avoided. To this end, the arms may preferably extend perpendicularly at least approximately six feet from the backboard.

The backboard 20 may be made of any suitable material, such as plywood. The backboard 20 may be planar as seen in FIG. 2 or take any other shape suitable for the sport to which the training is to be directed. For example, the backboard may be curved so that the arms are directed radially toward the athlete. The backboard 20 is preferably in a vertical position with the arms 10 extending horizontally therefrom. The location, number and alignment of the slots in the background may be selected to match the needs of the sport to which the training is directed. For example, slots at the knees may be appropriate for karate training.

The face of the backboard 20 toward the athlete may be padded to accept blows from the athlete without damages to the athlete. Additionally, a punching bag or punching dummy may be attached to the same face of the backboard to provide a target for the athlete. Preferably, all such padding and dummies are slotted as necessary to permit the passage of the arms.

The face of the backboard away from the athlete may include suitable braces 40 for holding the arms 10. The braces 40 may include horizontal guide rails to permit lateral sliding movement of the arms 10 or may operate as pivots to permit accurate movement of the ends of the arms 10.

With further reference to FIG. 2, the arms 10 may include handles 50 that may be used by the trainer to facilitate movement thereof. The handles 50 may extend horizontally, vertically or any appropriate direction.

Figure 4:
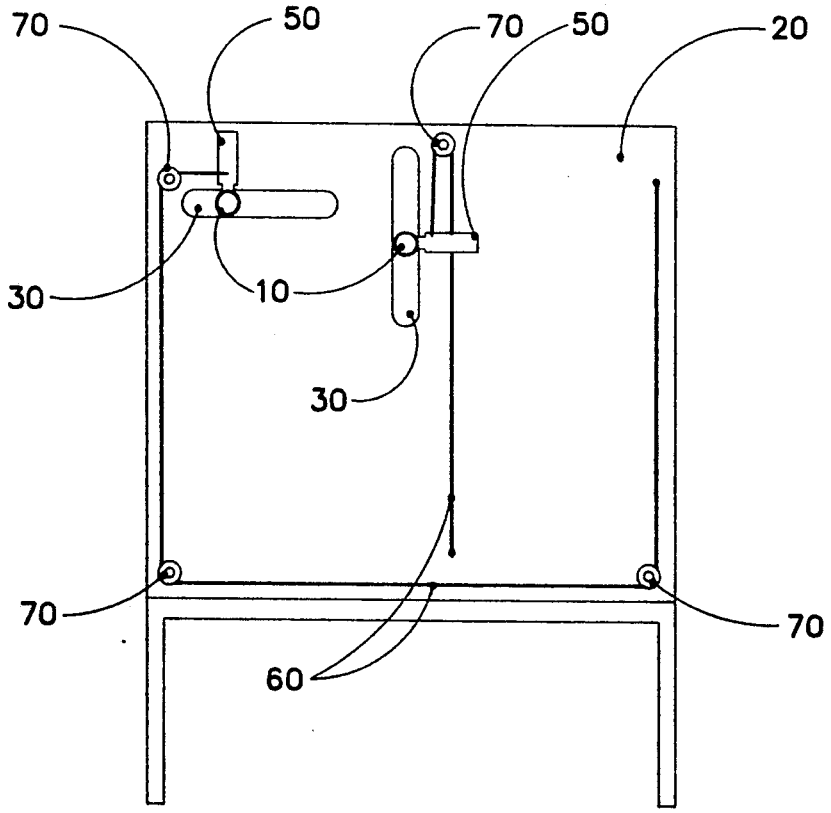
FIG. 4 is a back plan view of the embodiment of FIG. 1 with many of the slots omitted for clarity.

With reference now to FIG. 4, the present invention may include an elastic cord 60, such as "shockcord", for providing a force to retract the arm away from the athlete. By way of example, the arm 10 in FIG. 4 may be moved toward the center of the backboard 20 by the trainer and, when released, moved away from the center of the backboard by elastic cord 60. The elastic cord 60 may be attached to any suitable portion of the arm 10, such as the handle 50, and to the backboard 20.

It is desirable that the force encountered by the trainer when moving the arm 10 be relatively constant throughout the range of motion of the arm, or at least not to increase as the arm is moved toward the athlete. To this end, the elastic cord 60 may have a length (as may be seen, for example, in FIG. 4) that the force needed to move the arm is relatively constant. By using a cord 60 of sufficient length, an unpleasant and potentially harmful snap back of the arm may be avoided. Pulleys 70 may be provided on the face of the backboard 20 away from the athlete to provide a path for the cord 60.

With reference again to FIGS. 1 and 2, a platform 80 may be provided behind the backboard 20 so that the trainer can stand behind the board and view the athlete avoiding the movement of the arms. The platform 80 and handles 50 may be positioned so that the trainer may move any of the arms 10 while observing the athlete.

Figure 5:
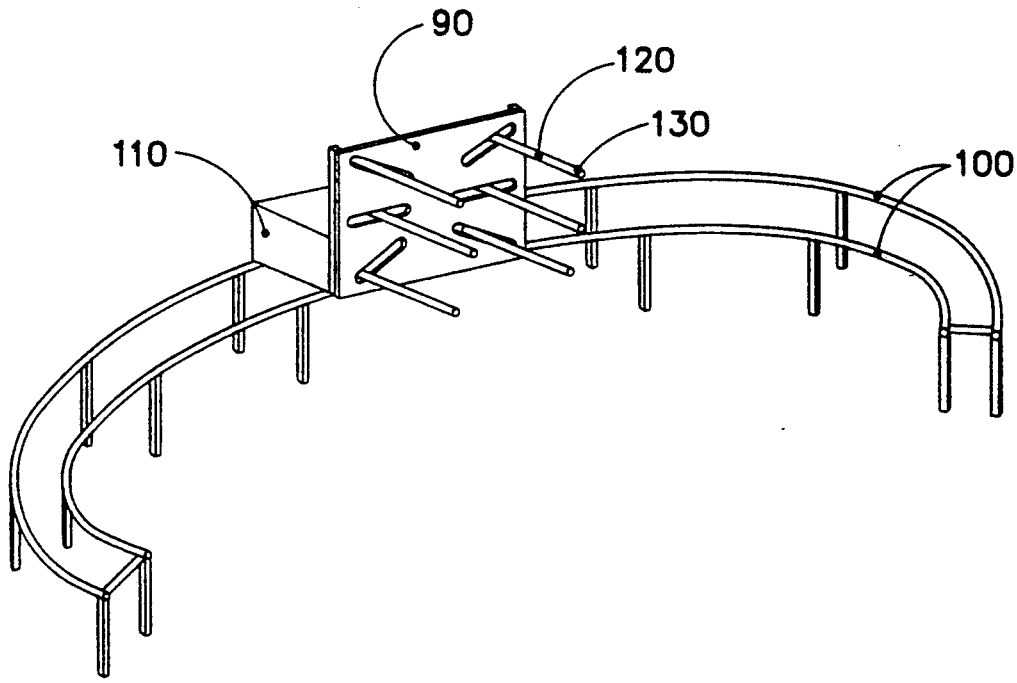
FIG. 5 is a perspective view of a pictorial representation of a second embodiment of the present invention.

In a further embodiment of the present invention shown in FIG. 5, the backboard 90 may be moveable. For example, the backboard 90 may be mounted on rails 100 suitably arranged so that the athlete may be forced to use footwork during reflex training. The backboard 90 may be propelled by the trainer or by a suitable motor 110.

In another embodiment, the device may be placed on wheels and/or pivoted so that the training can be accomplished against a moving target.

With further reference to FIG. 5, arms 120 may be illuminated by a light 130 when in motion. The use of the light may be optionally selected by the trainer and may be used to provide an additional indication to the athlete that a moving arm is to be avoided.

In still another embodiment of the invention, the arms 120 may be moved by suitable electrical or hydraulic motors attached to the backboard 90 which can be controlled remotely by the trainer. The operation of the motors may also be controlled by a computer which can be programmed to rapidly move the arms in various predetermined orders to "simulate" at varying speeds various combinations of attacks to be defended.

While preferred embodiments of the present invention have been described, it is understood that the embodiments described are illustrative only and that the scope of the invention is to be defined solely by the appended claims when accorded a full range of equivalence, many variations and modifications naturally occurring to those skilled in the art from a perusal thereof.

Figure 6:
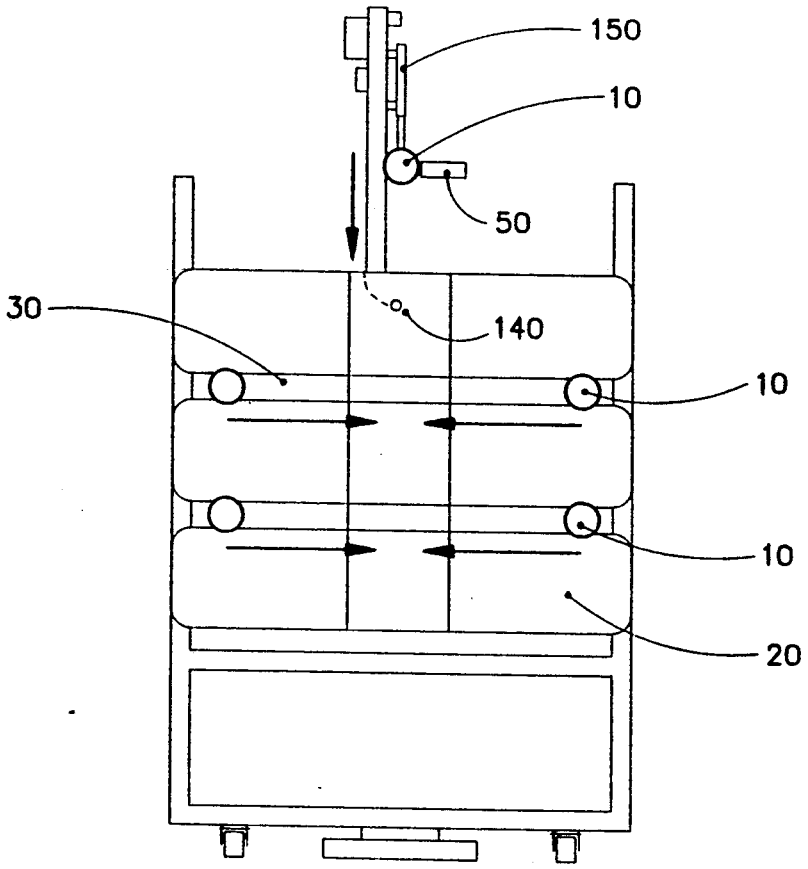
FIG. 6 is a front plan view of a third embodiment of the present invention.
Figure 7:
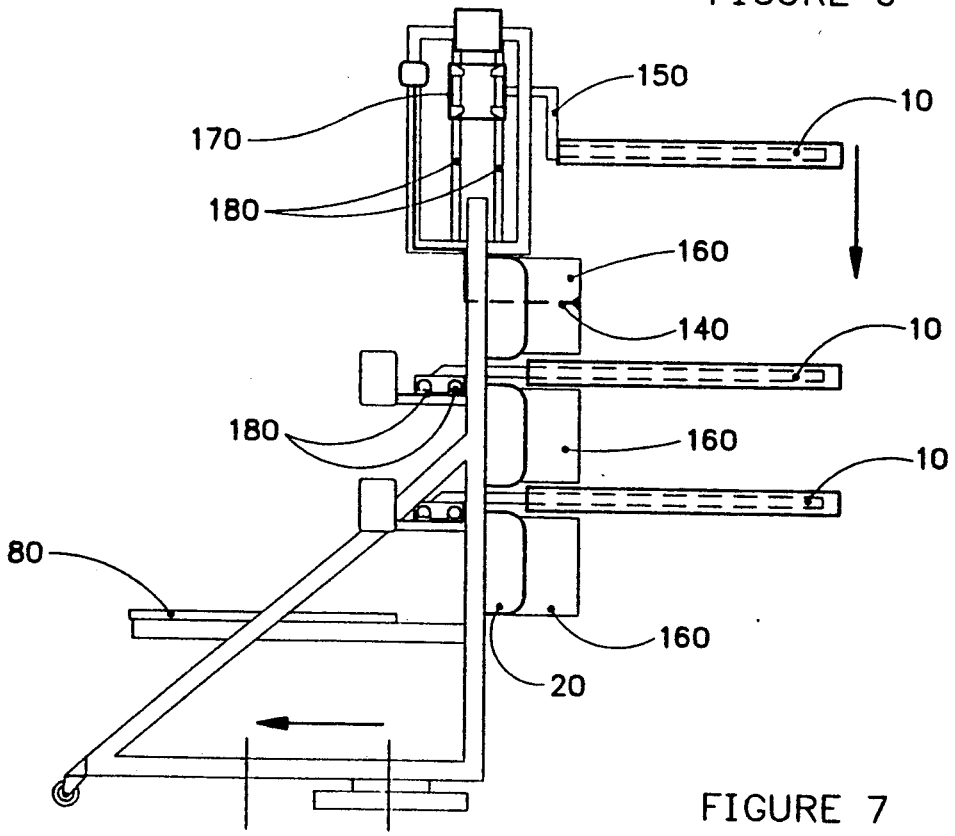
FIG. 7 is a side plan view of the embodiment of FIG. 6.
Figure 8:
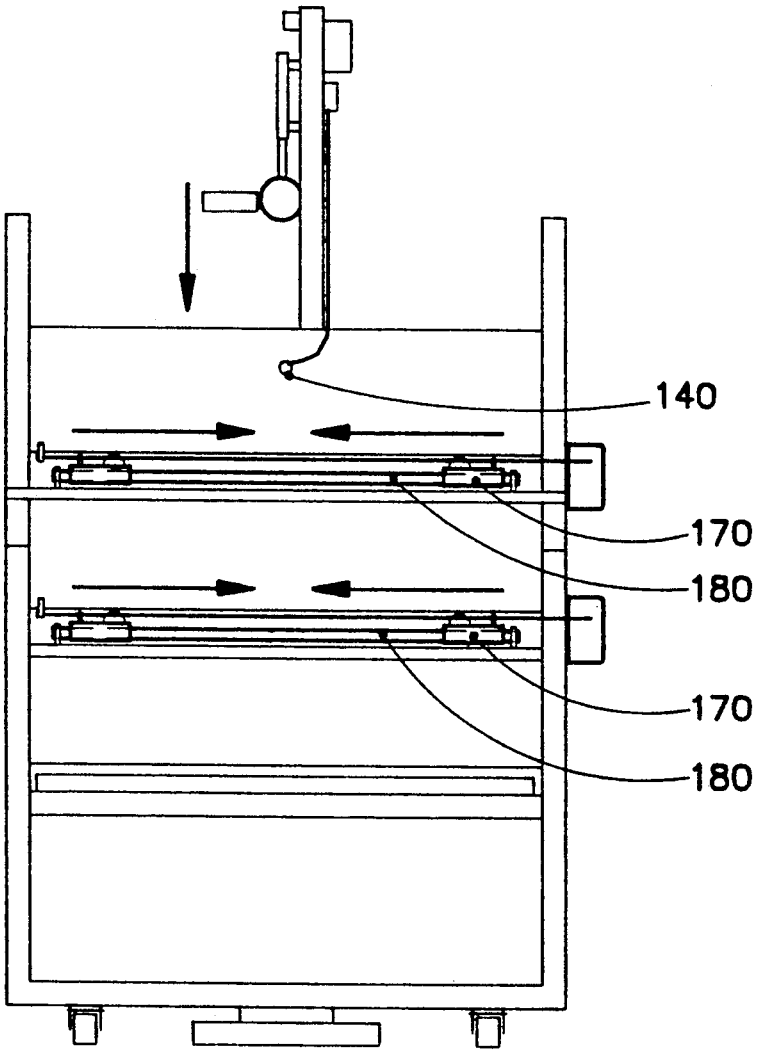
FIG. 8 is a back plan view of the embodiment of FIG. 6.

With reference to FIGS. 6–8, another embodiment of the present invention may include a backboard 20 and arms 10 which may move laterally through the slots 30 across the entirety of the backboard 20. A vertical arm may be provided above the backboard 20 and offset from its handle by an offset support 150. A light 140 may illuminated through a switch associated with the vertical arm to warn the athlete that the arm is in motion. By placing the light 140 through the backboard 20, the light 140 may be kept within the peripheral vision of the athlete while being trained.

The backboard 20 may be padded to prevent injury to the striking appendages of the athlete by a suitable pad 160.

To facilitate ease and movement of the arms 10, each of the arms 10 may be attached to a slit 170 which rides on a pair of tracks 180. The slit 170 may be equipped with roller bearings or the like between the slit 170 and the tracks 180.

I claim:

1. A device for training athletes comprising:

(a) backboard means for providing a generally vertical surface having plural slots therein;

(b) plural arms extending perpendicularly through said slots beyond an athlete positioned facing said vertical surface, said arms being adapted to be selectively moved in said slots in a direction generally parallel to said vertical surface and toward the sides of the positioned athlete; and (c) elastic means for providing a force to move said arms in said slots toward an edge of said vertical surface when not being selectively moved toward the athlete.

2. The device as defined in claim 1 wherein said arms extend through said slots approximately six feet.

3. The device as defined in claim 1 wherein said vertical surface is generally planar.

4. The device as defined in claim 1 wherein said elastic means provides a relatively constant force throughout the range of movement of said arms.

5. The device as defined in claim 1 further comprising handle means for moving said arms, said handle means being adapted to be used by a trainer from a face of said backboard means not facing the athlete.

6. The device as defined in claim 1 wherein said arms are flexible.

7. The device as defined in claim 1 wherein said arms are hinged.

8. The device as defined in claim 1 wherein at least one of said slots defines a range of movement that is substantially more horizontal than vertical.

9. The device as defined in claim 1 wherein at least one of said slots defines a range of movement that is substantially more vertical than horizontal.

10. The device as defined in claim 1 further comprising means for moving said backboard means.

11. The device as defined in claim 3 wherein said means for moving said backboard means comprises spaced-apart rails and means for conveying said backboard on said rails so that said backboard is able to move relative to said rails.

12. The device as defined in claim 4 further comprising a platform for elevating a trainer so that the trainer may observe the athlete trying to avoid the arms being moved by the trainer.

13. The device as defined in claim 1 wherein said arms further comprise light means for illuminating the arms being moved.

* * * * *